United States Patent [19]

Bode

[11] 4,279,114

[45] Jul. 21, 1981

[54] EQUIPMENT FOR MOUNTING A SCREW-CAP ON A CONTAINER

[75] Inventor: Günter Bode, Ohrum, Fed. Rep. of Germany

[73] Assignee: Schmalbach Lubeca GmbH, Brunswick, Fed. Rep. of Germany

[21] Appl. No.: 92,811

[22] Filed: Nov. 9, 1979

[30] Foreign Application Priority Data

Nov. 15, 1978 [DE] Fed. Rep. of Germany ..... 7833887

[51] Int. Cl.[3] ..... B67B 3/20; B65B 7/28

[52] U.S. Cl. ..... 53/314; 53/315; 53/318; 53/331.5

[58] Field of Search ..... 53/318, 331.5, 314, 53/315

[56] References Cited

U.S. PATENT DOCUMENTS

| | | | |
|---|---|---|---|
| 2,876,605 | 3/1959 | McElroy et al. | 53/315 |
| 3,477,202 | 11/1969 | Zetterberg | 53/318 X |
| 4,199,914 | 4/1980 | Ochs et al. | 53/315 X |

*Primary Examiner*—Horace M. Culver

*Attorney, Agent, or Firm*—Charles E. Brown

[57] ABSTRACT

This disclosure relates to apparatus for applying screw-on caps to containers. The caps are fed down a chute and are engaged by the mouths of containers. Each cap, after it is engaged with the mouth of a container, is pressure-urged down onto the container in a position parallel to the path of movement of the container and is rotated in a screw-off direction. It then moves to a position where it is engaged by another friction device and another hold-down device where it is rotated in a screw-on direction.

6 Claims, 3 Drawing Figures

EQUIPMENT FOR MOUNTING A SCREW-CAP ON A CONTAINER

This invention relates to equipment for mounting a screw-cap on a container, consisting of a horizontal conveyor track for the containers, of a supply track for the caps which is slanted with respect to said conveyor track, of a guide shoe located above the supply track in the region of the cap transfer, of spring-elastic holding members located upstream of the transfer site for keeping the cap being applied in an oblique position of its rim with respect to the path of motion of the container mouth until the container carries the cap along with it, and of levers with frictional surfaces acting on the cap to rotate the cap first against the direction of the screw-on and then in the direction of screw-on, and of at least one spring-biased compression plate for the cap mounted downstream of the guide shoe in the direction of conveyance.

In known equipment of the above kind (German Pat. No. 1,532,568), the holding members acting on the cap are simultaneously designed as levers having a spacing such that the cap is held initially prior to being carried along by the container mouth, at which time the levers are spread by spring action. One of these levers has a friction lining at its end, the other lever on the other hand has opposing the friction lining an especially smooth surface of abutment which cooperates with the cap to permit turning. In this manner, immediately after being carried along by the container mouth, the caps are rotated against the direction of the thread to prevent jamming and warping of the caps.

In this known equipment, the rotation of the cap opposite to the sense of screw-on takes place still in the transfer stage, that is, before the cap has assumed the position in which it will be level with the container mouth. This known equipment furthermore comprises guide rails in the transfer region which support the cap at its lower apron-rim, the cap being released from the rails only when, after the pre-rotation against the direction of screw-on has been completed, it arrives at a friction lining acting on one side of the cap surface, whereby the cap is rotated in the direction of screw-on to seal the container.

The known equipment suffers from the drawback that the cap, because of its pre-rotation against the sense of screw-on before it reaches its level position with respect to the container mouth, must retain an oblique position and subsequently no longer can achieve the required all-peripheral contact. Furthermore, the cap is not pressed on the rim of the mouth of the container by means of a support during pre-rotation, rather it will touch the rim of the mouth only when its rotation in the direction of the thread takes place. This is implemented in the known equipment by a friction surface acting from above on the cap to initiate the screw-on process which in general will be completed using friction means subsequently acting on the cap.

It is the object of the present invention to improve the prior equipment so that a full peripheral contact of the cap with the container mouth shall already be achieved prior to rotational motion of the cap in the screw-off direction, thereby to exclude any possibly oblique position of the cap on the container mouth. Furthermore, the pre-rotation of the cap in the direction of screw-on shall be simplified by the new equipment, while simultaneously ensuring that any filling material projecting above the upper rim of the mouth of the container will be squeezed off or compressed into the container.

The above problem is solved by modifying the prior equipment so that the levers are separate from the cap holding members and are of such different lengths that during spring-biased deflection they will rest by their free ends, which have friction linings, against the caps in consecutive and spaced relation for the purpose of initially rotating the cap against the direction of screw-on and then in the direction of screw-on, and so that the levers with their friction linings each extend below separate compression plates.

In the novel equipment, the levers act on the cap independently from each other, and thus cause rotation of the cap first against the direction of screw-on and then in the direction of screw-on. Regardless of the required frictional force transmitted by the levers to the cap, the compression forces from the compression plates mounted above the levers may be so adjusted as to ensure squeezing off or pushing in any filling material projecting from the container. The described arrangement of the two levers eliminates relatively costly and previously necessary apparatus acting at the top side of the cap surface and rotating the cap. Specifically, the required compression forces of the levers and the compression plates may be set independently from each other. This is impossible in equipment for screwing-on caps which act on the cap top side.

It is particularly appropriate to provide the levers with positioning screws to control the attitude angles of their friction linings with respect to the guide track. Because the levers act sideways on the cap skirts, they are externally accessible and therefore may be made to assume the most efficient diverse positions by means of the positioning screws to alter the attitude angle of the friction linings.

It is furthermore possible to mount the levers and the holding members on side plates which are transversely adjustable, In this manner the new equipment of this invention can be adjusted at little cost to accommodate various containers of cap diameters. Such a common adjustment of the supporting side plates in the sense of enlarging or decreasing their spacing transversely to the direction of conveyance is implemented using a worm drive connected to the supporting side plates. Accordingly the novel equipment can be used with various machinery for sealing containers of different mouth sizes and may be adjusted to the particular different cap diameters in an exceedingly simple manner by a few manual operations.

With the above and other objects in view that will hereinafter appear, the nature of the invention will be more clearly understood by reference to the following detailed description, the appended claims, and the several views illustrated in the accompanying drawings.

IN THE DRAWINGS

Figure 3:
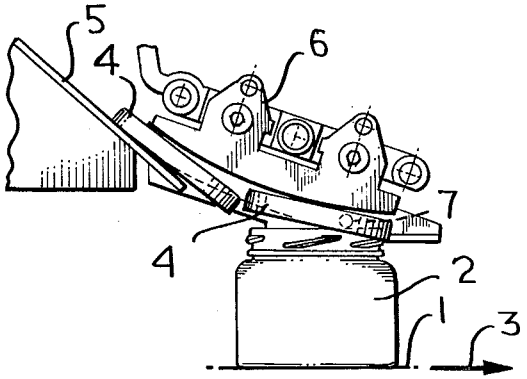
FIG. 3 is an enlarged side view of the transfer position of a cap showing the manner in which the caps are carried along at the time of engagement by a container.

A conveyor track for moving containers 2 in the direction of the arrow 3 is indicated schematically in FIG. 3 of the drawings.

As shown in FIG. 3, a supply track 5 in the form of a chute is provided above the conveyor track 1 at a transfer station for transferring caps 4 onto containers 2, the caps 4 moving in sequence down the chute and resting on their diametrically opposite side areas on spaced apart flange-like portions of the supply track 5 until they reach the guide shoe 6 at the bottom as shown in FIG. 3. At that location, the first cap of the sequence of caps is prevented from moving further by pins 7 spring-biased transversely of the chute, and in particular at that spot where the rim of the mouth of the container will carry the first cap along, as shown in FIG. 3.

Figure 1:
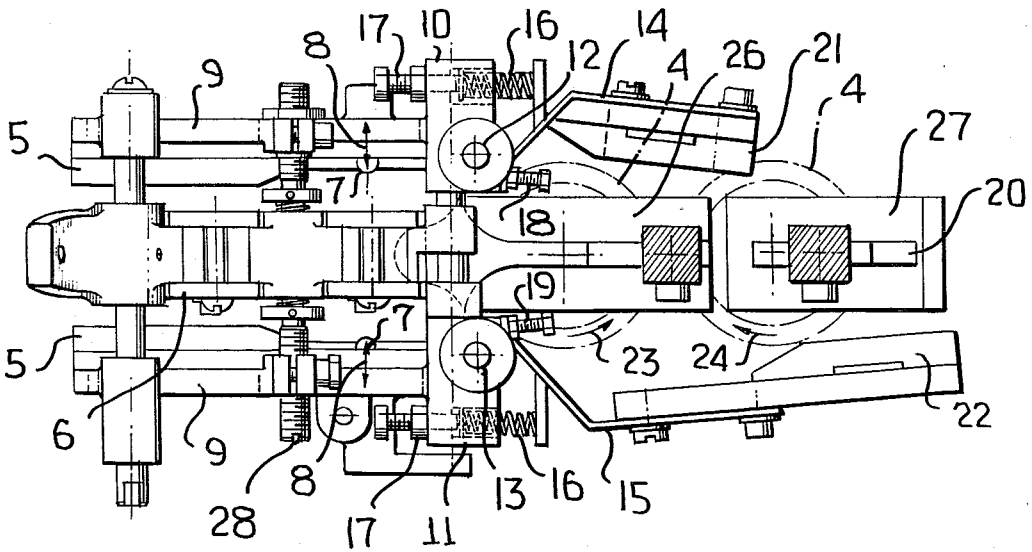
FIG. 1 is a top plan view with parts in section of the equipment for mounting the screw cap according to the invention.

The spring-biased pins 7, which are also shown in FIG. 1, are retained for transverse movement in supporting side plates 9 in the sense of the double arrows 8 shown in FIG. 1. The side plates 9 carry at their right ends in FIG. 1 thrust bearings 10 and 11 which hold levers 14 and 15 respectively pivoting about axes 12 and 13. The levers 14 and 15 are acted on by springs 16 with associated prestressed screws 17 which bias the levers 14 and 15 into mutual converging pivotal motion. The levers 14 and 15 are prevented from this pivotal motion by positioning screws 18 and 19. The positioning screws 18 and 19 also determine the attitude angle of the levers 14 and 15 with respect to a central longitudinal line 20 of the equipment.

The levers 14 and 15 are of different lengths, the lever 14 being substantially shorter than the lever 15. The two levers are provided at their free ends with brake or frictional linings 21 and 22 for cooperation with caps 4 mounted on the containers 2, as shown in dash-dot lines in FIG. 1. Each cap 4 thereby is first rotated by the brake or frictional lining 21 of the lever 14 in the direction of the arrow 23, i.e., against the direction of screw-on, whereas, immediately after passing the lever 14, the cap will be rotated by the lever 15 in the direction of the arrow 24, i.e., in the direction of screw-on, before—after leaving the lever 15, i.e., the associated friction lining 22—it arrives underneath a belt arrangement 25 shown in FIG. 2 which continues the screw-on motion of the cap.

Figure 2:
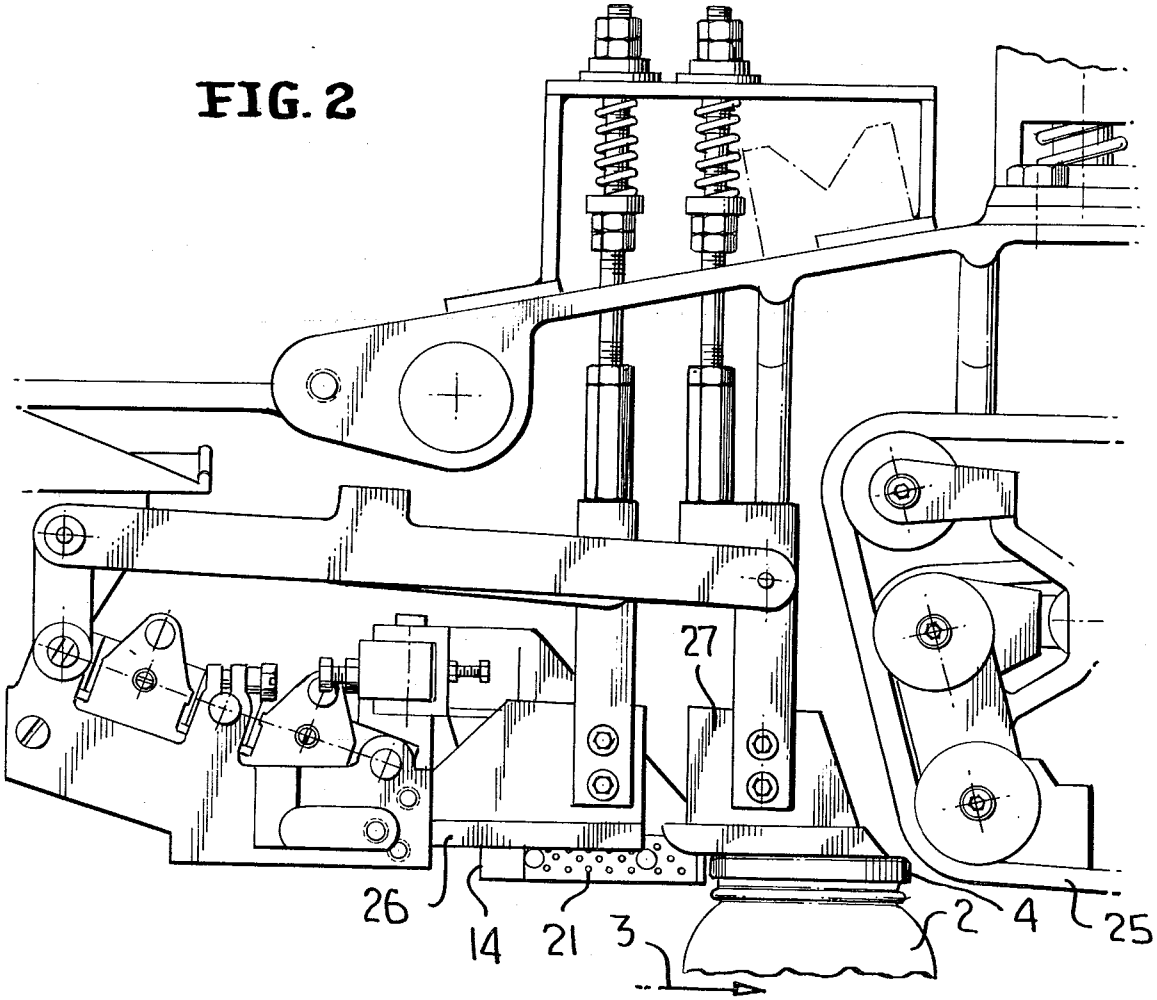
FIG. 2 is an enlarged fragmentary side view of the equipment of FIG. 1.

While the lever 14 acts on a cap 4, this cap at the same time is pressed by a spring-biased compression plate 26 against the mouth of the container. Another compression plate 27, also spring-biased, is provided in the region of action of the lever 15, the plate 27 also pressing by means of an adjustable spring force against the cap toward the mouth of the container 2, whereby any goods projecting from the container orifice will be forced into the container or will be squeezed off its rim by the combined compressive and rotational motion. In FIG. 2 there is shown the spring-biased means for holding down the compression plates 26 and 27. These spring-biased means need not be discussed in detail in that they are generally known in equipment for mounting screw caps.

It is clear from the drawings that each cap 4 will first be carried along at the mounting station by the mouth of container 2 in the direction of motion 3 until the cap is level with the mouth of the container. Immediately after being carried along and upon leaving the guide shoe 6, the cap is subjected to the action of the compression plate 26, whereby it is pressed onto the mouth of the container 2 before the lever 14 with its associated friction lining 21 becomes effective in the manner described above, namely rotating the cap against the sense of screw-on. One makes sure also that the cap is level with, not slanting, with respect to the mouth of the container 2, so that subsequently by the action of the second lever 15 and of the compression plate 27 it will be screwed onto the container, at least to the extent that there is sufficient engagement with the threads to thereafter firmly screw the cap onto the container using the belt system 25.

To apply the described equipment to caps of different diameters, the side-plates 9 which carry the flanges defining the chute 5 supporting other elements of the equipment may be adjustably spaced at various transverse distances by means of a worm screw spindle arrangement 28.

What is claimed as new is:

1. A device for applying a screw cap on a container; said device comprising a horizontal conveyor for containers, a chute for delivering caps to a cap transfer point, said chute being inclined toward said horizontal conveyor, a guide shoe arranged in the area of said cap transfer point above said chute, resilient holding elements arranged upstream of said cap transfer point for holding a cap by its skirt in an inclined position to the path of travel of a container until the cap is picked up by the container, levers having friction surfaces for gripping a cap by its skirt for turning the cap, and at least two resilient cap hold-down plates arranged downstream of said guide shoe; the improvement residing in said levers being independent of said resilient holding elements said levers having pivots aligned transversely of said conveyor, and said levers being of such different lengths that their friction surfaces grip a cap by its skirt sequentially and separately for turning caps first opposite to the direction of screw-on and then in the direction of screw-on, and said friction surfaces of said levers each extending alongside and below the plane of a separate one of said hold-down plates.

2. Device according to claim 1 wherein there are means separately pivotally mounting each of said levers, and said levers have adjusting means for changing the angle of attack of said friction surface relative to the longitudinal axis of said conveyor.

3. Device according to claim 2, wherein said levers and said holding élements are arranged on lateral supporting members and there are means for adjusting the transverse distance between said supporting members.

4. Device according to claim 3, wherein said means for adjusting said supporting members include a spindle drive for simultaneous adjustment of supporting cheeks to selectively increase or decrease said transverse distance.

5. Device according to claim 1, wherein said levers and said holding elements are arranged on lateral supporting members and there are means for adjusting the transverse distance between said supporting members.

6. Device according to claim 5, wherein said means for adjusting said supporting members include a spindle drive for simultaneous adjustment of supporting cheeks to selectively increase or decrease said transverse distance.

* * * * *